US008251652B2

(12) United States Patent
Campbell et al.

(10) Patent No.: US 8,251,652 B2
(45) Date of Patent: Aug. 28, 2012

(54) GAS TURBINE VANE PLATFORM ELEMENT

(75) Inventors: Christian X. Campbell, Oviedo, FL (US); Anthony L. Schiavo, Oviedo, FL (US); Jay A. Morrison, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 622 days.

(21) Appl. No.: 12/479,082

(22) Filed: Jun. 5, 2009

(65) Prior Publication Data

US 2010/0183435 A1 Jul. 22, 2010

Related U.S. Application Data

(60) Provisional application No. 61/097,927, filed on Sep. 18, 2008, provisional application No. 61/097,928, filed on Sep. 18, 2008.

(51) Int. Cl.
*F01D 9/04* (2006.01)

(52) U.S. Cl. ..... 415/209.3

(58) Field of Classification Search ..... 415/209.3, 415/137, 191, 209.4, 210.1
See application file for complete search history.

(56) References Cited

U.S. PATENT DOCUMENTS 3,836,282 A * 9/1974 Mandelbaum et al. .... 415/209.4
5,630,700 A * 5/1997 Olsen et al. ..... 415/134
5,797,725 A * 8/1998 Rhodes ..... 415/209.4
6,200,092 B1 3/2001 Koschier
6,290,459 B1 * 9/2001 Correia ..... 415/139
6,464,456 B2 10/2002 Darolia et al.
6,648,597 B1 * 11/2003 Widrig et al. ..... 415/210.1
6,758,653 B2 7/2004 Morrison
6,984,101 B2 1/2006 Schiavo, Jr.
7,093,359 B2 8/2006 Morrison et al.
7,114,917 B2 10/2006 Legg
7,201,564 B2 4/2007 Bolms et al.
7,255,534 B2 8/2007 Liang
7,278,820 B2 10/2007 Keller
7,281,895 B2 10/2007 Liang
7,316,539 B2 1/2008 Campbell
2005/0254942 A1 * 11/2005 Morrison et al. ..... 415/200
2006/0222487 A1 10/2006 Au
2006/0228211 A1 10/2006 Vance et al.
2007/0237630 A1 10/2007 Schiavo, Jr. et al.
2008/0087021 A1 4/2008 Radonovich et al.

* cited by examiner

*Primary Examiner* — Richard Edgar

(57) ABSTRACT

A gas turbine CMC shroud plate (48A) with a vane-receiving opening (79) that matches a cross-section profile of a turbine vane airfoil (22). The shroud plate (48A) has first and second curved circumferential sides (73A, 74A) that generally follow the curves of respective first and second curved sides (81, 82) of the vane-receiving opening. Walls (75A, 76A, 77A, 78A, 80, 88) extend perpendicularly from the shroud plate forming a cross-bracing structure for the shroud plate. A vane (22) may be attached to the shroud plate by pins (83) or by hoop-tension rings (106) that clamp tabs (103) of the shroud plate against bosses (105) of the vane. A circular array (20) of shroud plates (48A) may be assembled to form a vane shroud ring in which adjacent shroud plates are separated by compressible ceramic seals (93).

6 Claims, 9 Drawing Sheets

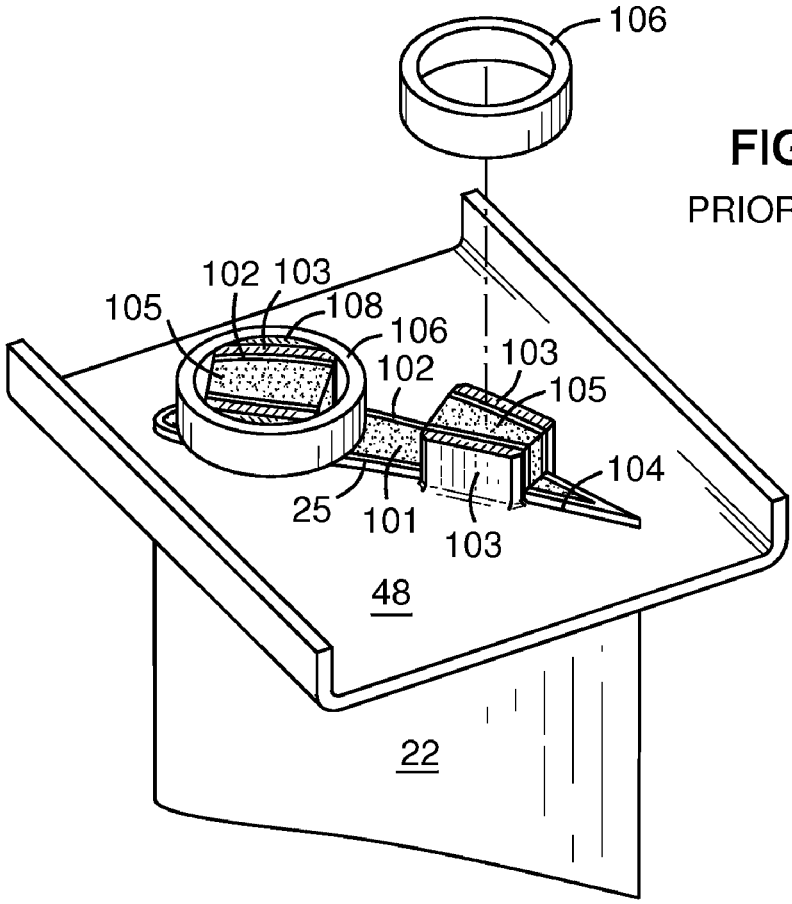
FIG 9
PRIOR ART
FIG 10
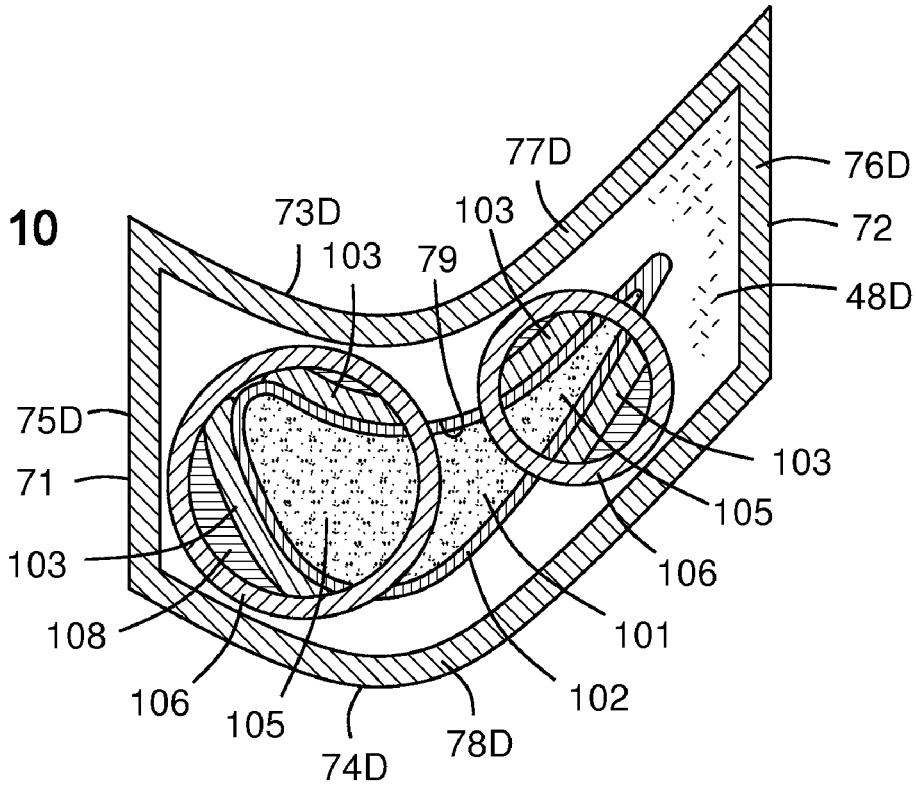

GAS TURBINE VANE PLATFORM ELEMENT

CROSS-REFERENCE TO RELATED APPLICATIONS

Applicants claim the benefit of U.S. provisional patent applications 61/097,927 and 61/097,928, both filed on Sep. 18, 2008, and incorporated by reference herein.

STATEMENT REGARDING FEDERALLY SPONSORED DEVELOPMENT

Development for this invention was supported in part by Contract No. DE-FC26-05NT42644 awarded by the United States Department of Energy. Accordingly, the United States Government may have certain rights in this invention.

FIELD OF THE INVENTION

This invention relates to a combustion turbine vane assembly with a vane airfoil attached to a ceramic matrix composite (CMC) platform member having structural side walls.

BACKGROUND OF THE INVENTION

Combustion turbine engines include a compressor assembly, a combustor assembly, and a turbine assembly. The compressor compresses ambient air, which is channeled into the combustor where it is mixed with fuel and burned, creating a heated working gas. The working gas can reach temperatures of about 2500-2900° F. (1371-1593° C.), and is expanded through the turbine assembly. The turbine assembly has a series of circular arrays of rotating blades attached to a central rotating shaft. A circular array of stationary vanes is mounted in the turbine casing just upstream of each array of rotating blades. The stationary vanes are airfoils that redirect the gas flow for optimum aerodynamic effect on the next array of rotating blades. Expansion of the working gas through the rows of rotating blades and stationary vanes causes a transfer of energy from the working gas to the rotating assembly, causing rotation of the shaft, which drives the compressor.

The vane assemblies may include an outer platform element attached to the distal or outer end of the vane. An inner platform element is connected to the inner end of the vane. The outer platform elements are mounted adjacent to each other in a circular array that defines an outer shroud ring attached to a support ring on the turbine casing. The inner platform elements are adjacent to each other to define an inner shroud ring. The outer and inner shroud rings define an annular working gas flow channel between them.

Surrounding each disc of rotating blades is an outer shroud ring assembled as a circular array of arcuate ring segments. The ring segments and vane platforms must withstand high mechanical loads, cyclic stresses, and thermal stresses. They may be made of superalloy metals for strength and ceramic materials for thermal tolerance. For example, a vane platform may be made of a superalloy vane support structure with a ceramic matrix composite (CMC) cover or shroud plate that protects the metal from the combustion gas.

BRIEF DESCRIPTION OF THE DRAWINGS

The invention is explained in the following description in view of the drawings that show:

FIG. 9 shows a prior art vane attachment device using compression rings.

FIG. 10 shows a vane attachment with compression rings on a fourth embodiment of the invention.

DETAILED DESCRIPTION OF THE INVENTION

Figure 1:
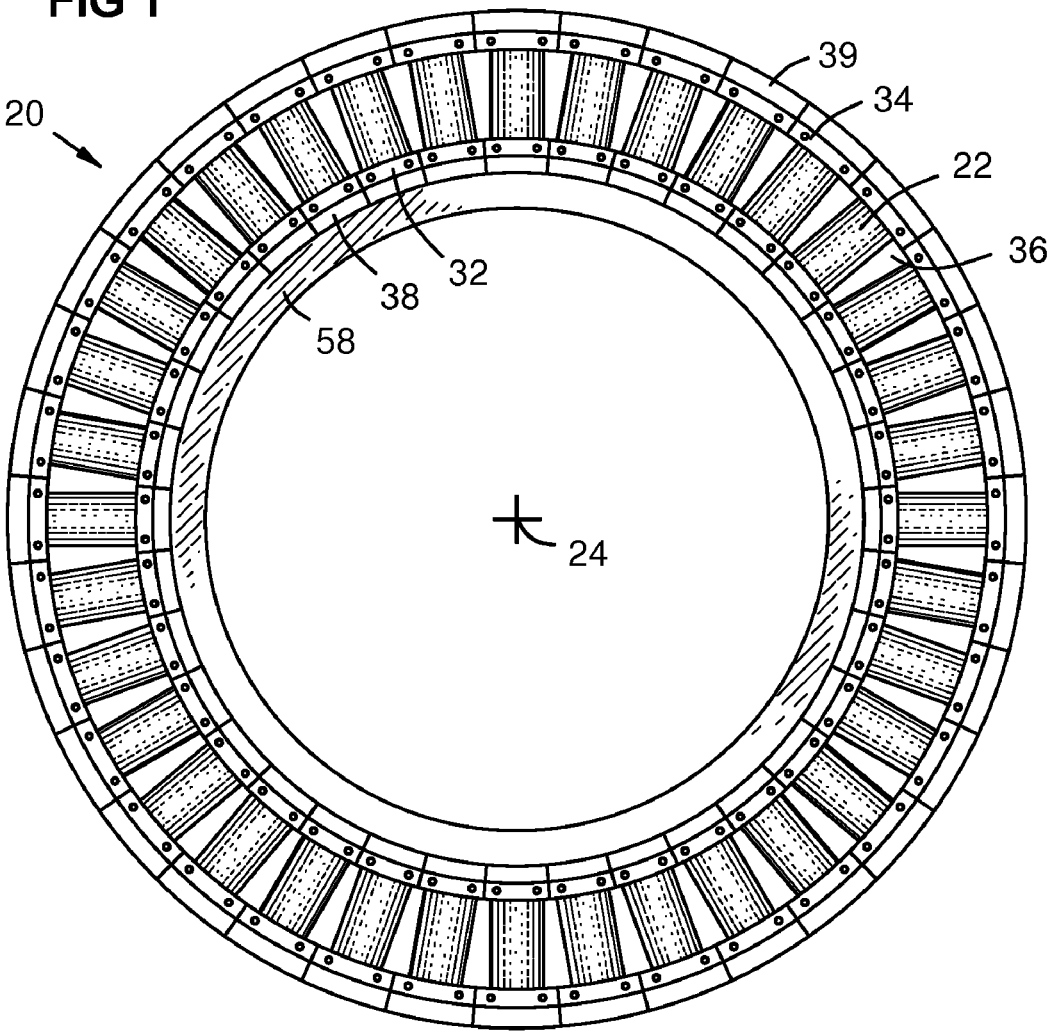
FIG. 1 illustrates a circular array of turbine vanes and platforms as viewed along the turbine axis.

FIG. 1 shows turbine vanes 22 in a circular array 20 of vane assemblies forming inner 32 and outer 34 shroud rings that channel combustion gas 36 over the vanes. Inner 38 and outer 39 backing plates and an inner U-ring 58 are later described. The terms "axial," "radial" and "circumferential" and variations thereof are intended to mean relative to the turbine axis 24 when an element is installed in its operational position.

Figure 2:
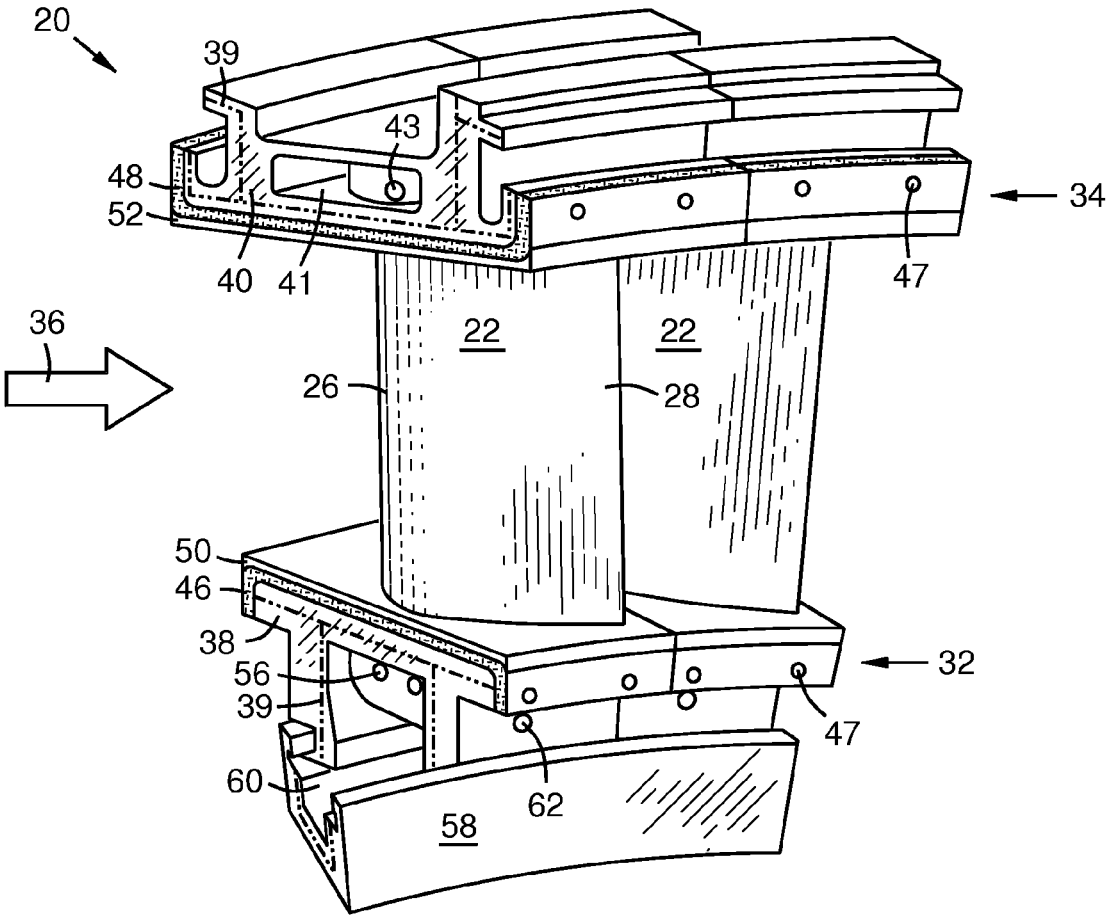
FIG. 2 is a perspective view of two exemplary vane assemblies.

FIG. 2 shows two stationary turbine vanes 22 assembled between inner 32 and outer 34 shroud rings in a design owned by the assignee of the present invention. The combustion gas 36 passes through the annular path between the shroud rings, and over the vanes 22. Each shroud ring 32, 34 is formed of adjacent backing plates 38, 40 with respective CMC shroud plates 46, 48. Each vane 22 has a leading edge 26 and a trailing edge 28, and spans radially between the inner and outer backing plates 38, 40. The backing plates 38, 40 may be formed of a high-temperature metal alloy. The outer backing plate 40 may contain a plenum 41, providing access to channels for pins 43 to lock the vane 22 to the backing plate 40 and/or to the shroud plate 48 via socket walls as in FIG. 3. Pins 43, 47, and 62 may be used to hold the assembly together. The inner backing plate 38 may have coolant outlets 56. A coolant such as air or steam may flow radially inward through the vanes 22, and exit the cooling outlets 56. The inner backing plates 38 support a U-ring 58 that forms an inner plenum 60 for return or exhaust of the coolant. Pin channels 62 may be provided for locking the inner end of the vane 22 into the inner backing plate 38.

The CMC shroud plates 46, 48 cover exposed surfaces of the backing plates 38, 40, and are fastened to the backing plates with pins 47 or other means, to protect the backing plates from the working gas. Ceramic thermal barrier coatings 50, 52 may be applied to the shroud plates 46, 48 as known in the art. Inter-platform gas seals 39 such as metal blade seals may be seated in slots in the circumferential sides of the backing plates to seal between adjacent backing plates as known in the art.

Figure 3:
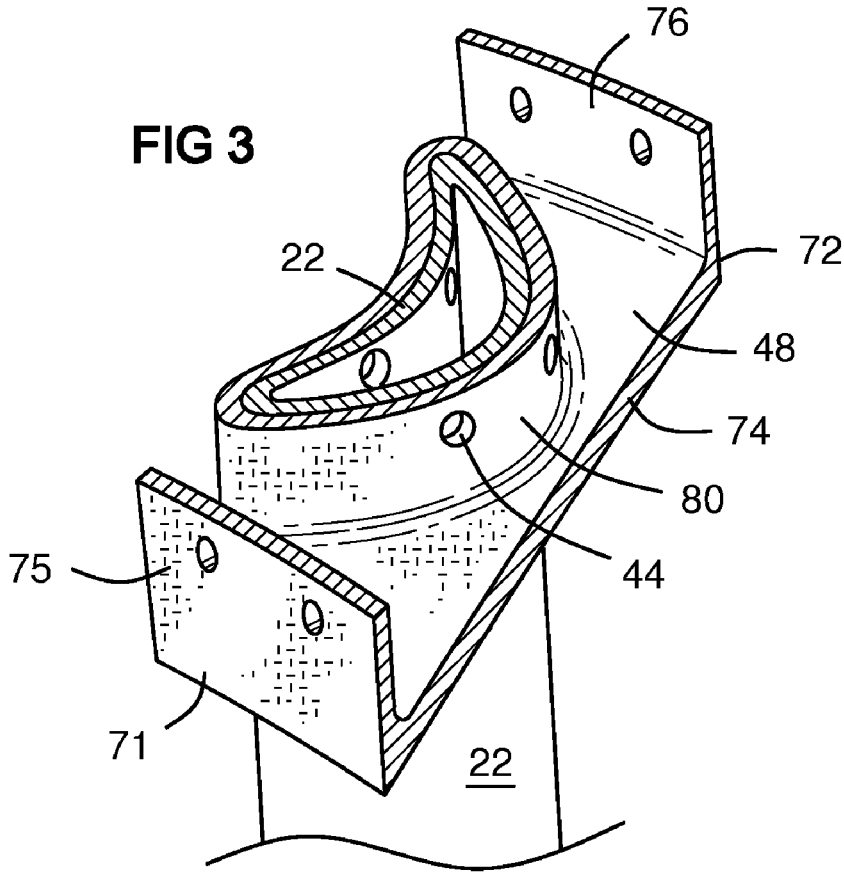
FIG. 3 is a perspective view of a vane and shroud plate from assembly of FIG. 2.

FIG. 3 shows a CMC shroud plate 48 with an upstream side 71, a downstream side 72, a circumferential side 74, an upstream side wall 75, a downstream side wall 76, and a socket wall 80 with pin channels 44. The side walls 75, 76 do not form a continuous frame around the periphery of the shroud plate. A vane 22 is inserted in the matching socket 80, and is attached therein with pins or other means.

Figure 4:
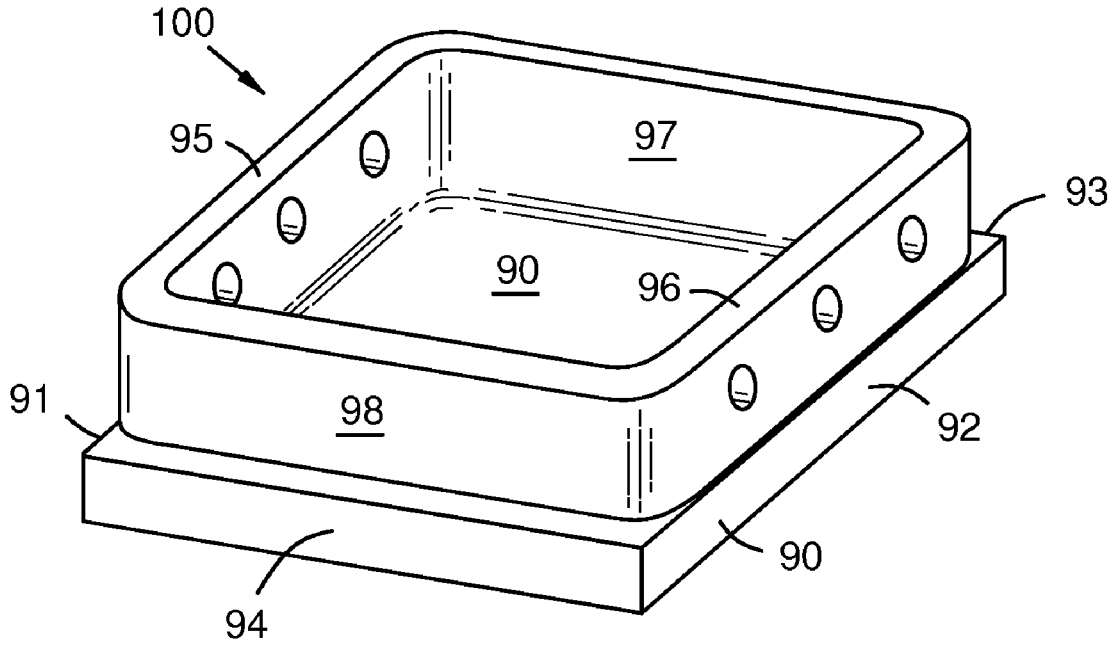
FIG. 4 is a perspective view of a CMC shroud ring segment with a continuous box frame wall structure.

FIG. 4 shows a turbine blade shroud ring segment 100, with a base plate 90, an upstream side 91, a downstream side 92, first and second circumferential sides 93, 94, an upstream side wall 95, a downstream side wall 96, and first and second circumferential side walls 97, 98. The side walls 95, 96, 97, 98 form a continuous frame around the periphery of the base plate. This structure has proven to be a highly robust structure. The inventors recognized that it would be desirable to use this type of closed frame on a vane shroud plate.

Figure 5:
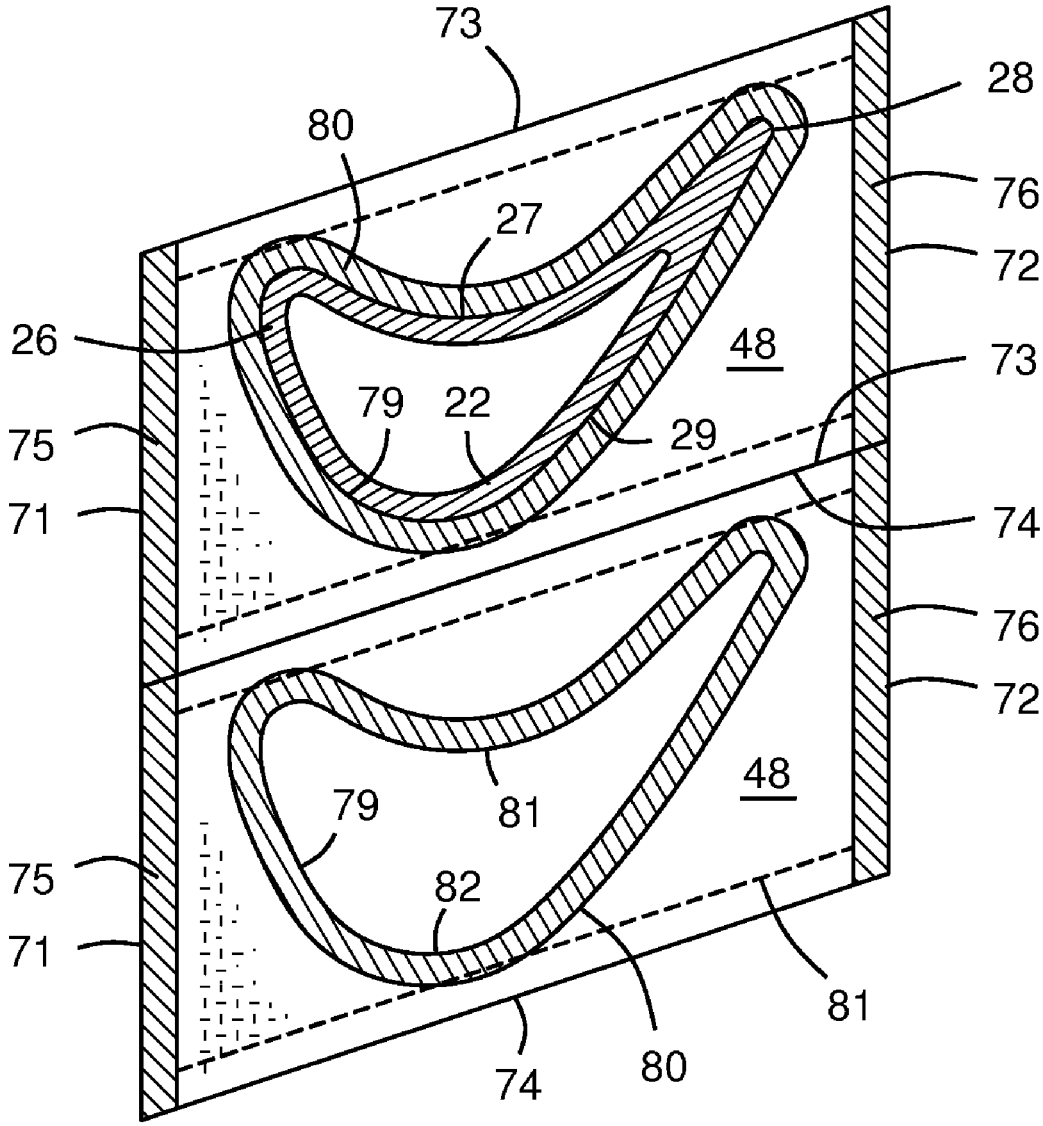
FIG. 5 is a backside view of two adjacent vane shroud plates per the assembly of FIG. 2, illustrating crowding with proposed additional walls in dashed lines.

FIG. 5 illustrates a problem with using a closed frame on a vane platform element. It shows a backside view of two adjacent vane shroud plates. Each shroud plate 48 has an upstream side 71, a downstream side 72, and first and second circumferential sides 73, 74. The two plates are adjacent at circumferential sides as shown. A vane 22 with a concave pressure side 27 and a convex suction side 29 is mounted in a socket 80 in the upper plate 48. The lower plate is shown without a vane. Each plate has a vane-receiving opening 79 that matches the cross section profile of the vane airfoil. The vane-receiving opening has a convex curve 81 matching the pressure side 27 of the airfoil, and a concave curve 82 matching the suction side 29 of the airfoil. Dashed lines 81 show a proposed wall on each circumferential side of the shroud plate to form a closed frame structure as in FIG. 4. However, it is seen that such frame walls would intersect or crowd the socket 80.

Figure 6:
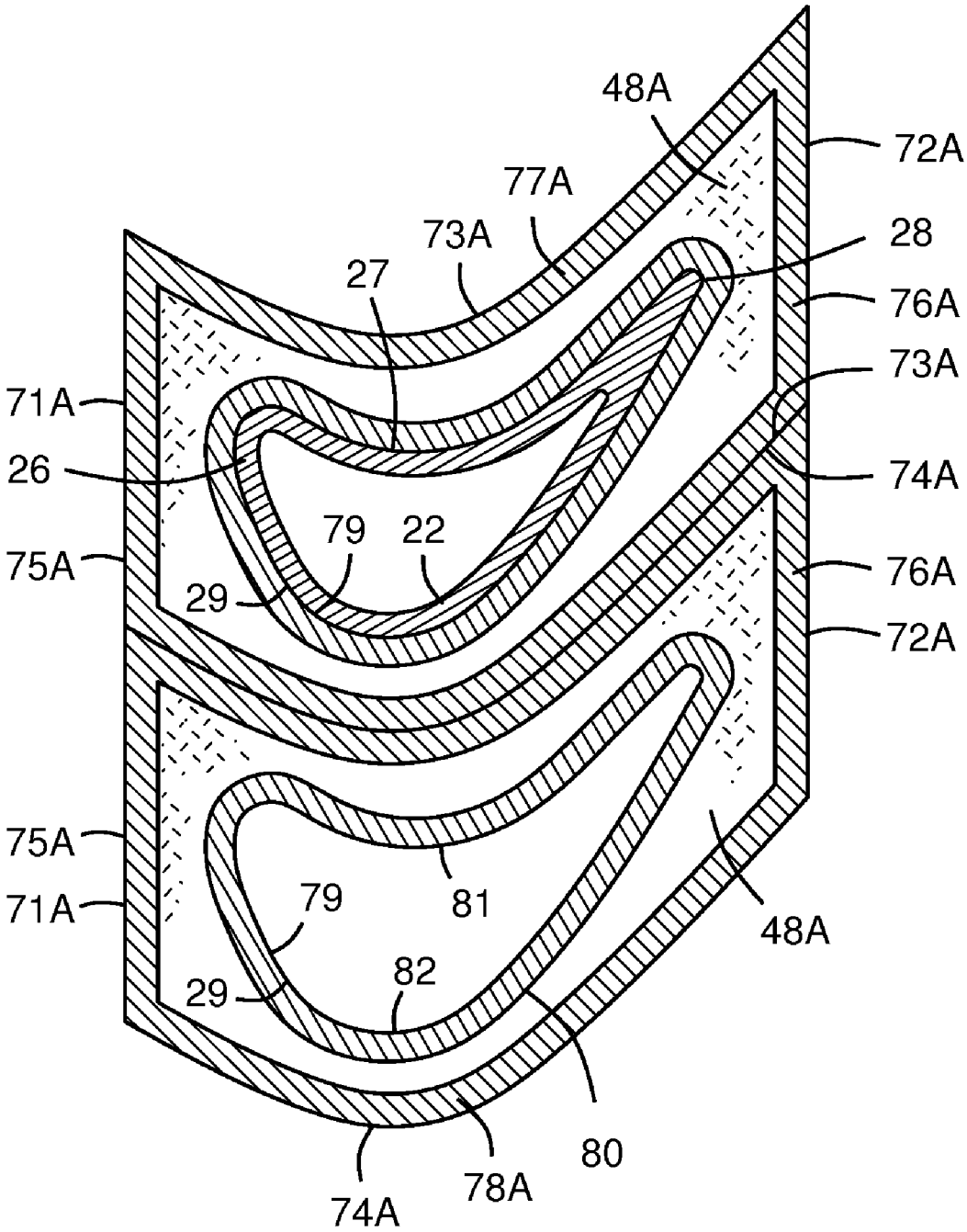
FIG. 6 is a backside view of two adjacent vane shroud plates in accordance with a first embodiment of the invention.

FIG. 6 shows a solution to this crowding according to the present invention. Two adjacent vane shroud plates 48A are shown, each having an upstream side 71A, and downstream side 72A, and first and second circumferential sides 73A, 74A. The two plates 48A are adjacent at circumferential sides as shown. A vane 22 with a concave pressure side 27 and a convex suction side 29 is mounted in a socket 80 in the upper plate 48A. The lower plate is shown without a vane. Each socket has a vane-receiving opening 79 that matches the cross section profile of the vane airfoil. The vane-receiving opening 79 has a convex curve 81 matching the pressure side 27 of the airfoil, and a concave curve 82 matching the suction side 29 of the airfoil. The circumferential side 73A is curved to generally follow the adjacent convex curve 81 of the vane-receiving opening. The circumferential side 74A is curved to generally follow the adjacent concave curve 82 of the vane-receiving opening. Herein "generally follow" means each circumferential side 73A, 74A is either concave or convex in accordance with the adjacent curve 81, 82 of the vane-receiving opening. For example, the circumferential side 74A is convex to match the concave curve 82 of the vane-receiving opening. This provides space for circumferential side walls 77A, 78A without crowding to form a continuous or closed frame structure 75A, 76A, 77A, 78A, making the vane shroud plate 48A stronger than the vane shroud plate 48 of FIG. 5. Each of the circumferential sides 73A, 73B may be smoothly curved as shown, or may be formed of two or more linear segments, not shown.

Figure 7:
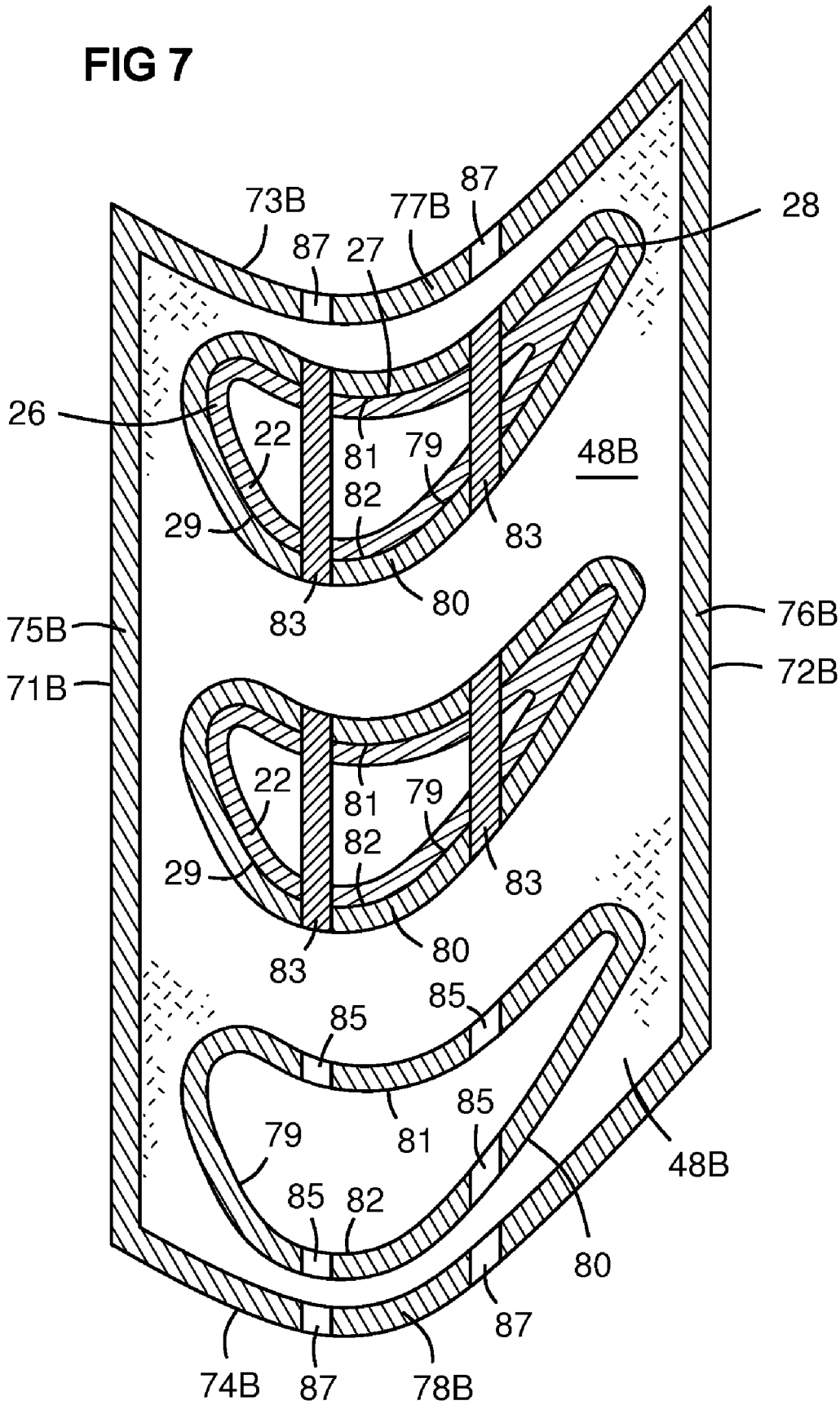
FIG. 7 is a backside sectional view taken on a plane through attachment pins in a second embodiment of the invention.

FIG. 7 shows another embodiment of the invention, in which multiple vanes 22 share a single shroud plate 48B having an upstream side 718, a downstream side 72B, and first and second circumferential sides 73B, 74B. A vane 22 with a concave pressure side 27 and a convex suction side 29 is mounted in each of the two upper sockets 80. The lower socket is shown without a vane. Each socket has a vane-receiving opening 79 that matches a cross section profile of the vane airfoil. The vane-receiving opening 79 has a convex curve 81 matching the pressure side 27 of the airfoil, and a concave curve 82 matching the suction side 29 of the airfoil. The circumferential side 73B of the shroud plate is curved to generally follow the adjacent convex curve 81 of the nearest vane-receiving opening 79. The circumferential side 74B of the shroud plate is curved to generally follow the adjacent concave curve 82 of the nearest vane-receiving opening 79. This provides space for circumferential side walls 77B, 78B that follow the circumferential sides 73B, 74B of the shroud plate 48B without crowding to form a continuous frame structure 75B, 76B, 77B, 78B that makes the vane shroud plate 48B stronger than the vane shroud plate 48 of FIG. 5. The increased strength of the plate 48B makes a larger plate with multiple sockets 80 more practical. This multi-vane shroud plate design reduces cost and reduces coolant leakage due to fewer seals needed in the vane shroud.

FIG. 7 shows pins 83 in pin channels 85 in the sockets 80 and vanes 22. A pin access hole 87 may be provided in at least one of the circumferential ends 73B, 74B as part of, and aligned with, each pin channel. The pins can be retained by clips, circlips, cotterpins, lock wire, or other known means. Pins or other such retaining mechanisms may be used behind both the inner and outer shrouds, or in only one of those two locations, as needed to provide the required radial support. The pins, in turn, may be attached to a metal substructure (not shown) for transferring loads to the engine frame. A bolt or other shaped mechanical attachment may be used in lieu of a pin in order to facilitate such attachment while accommodating differential thermal expansion.

Figure 8:
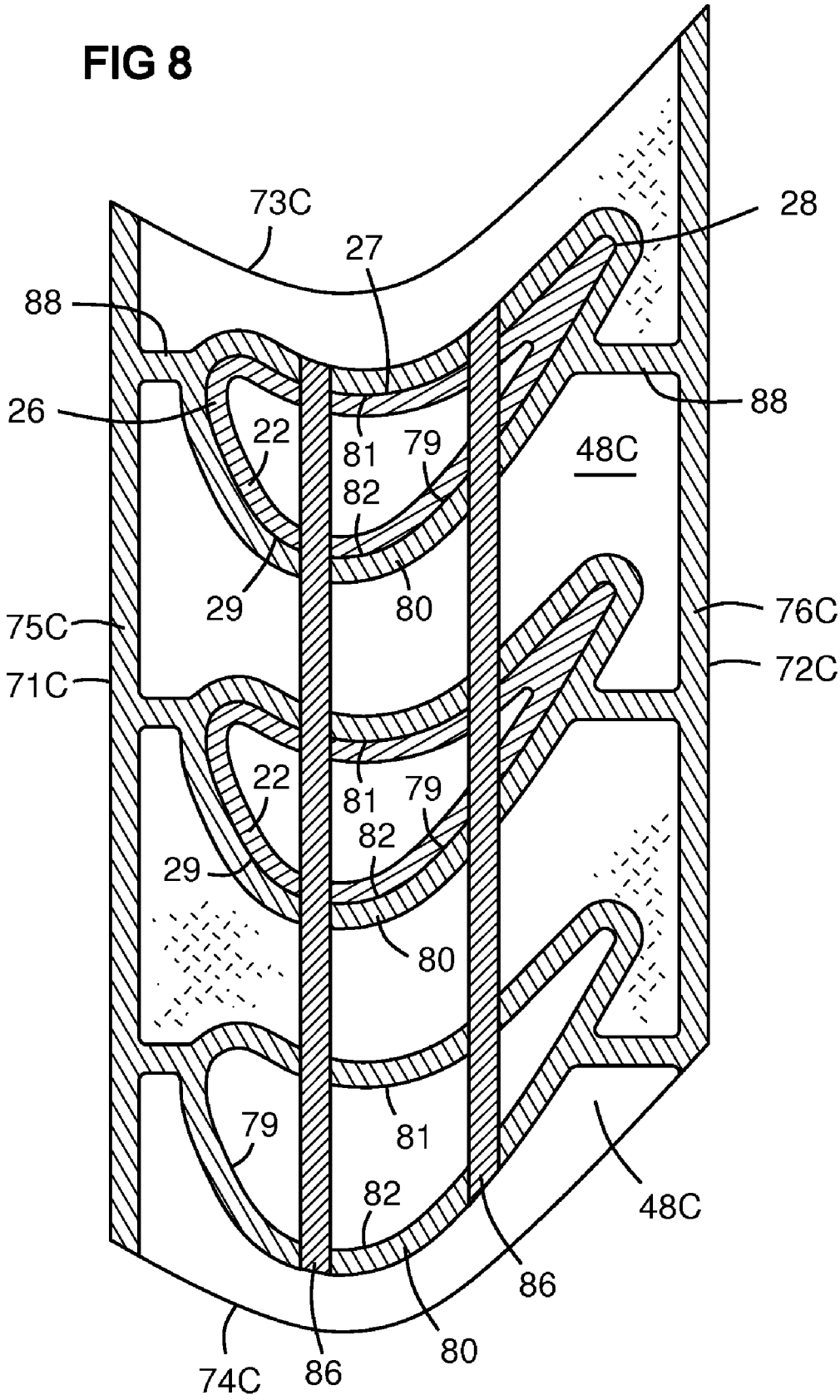
FIG. 8 is a backside sectional view taken on a plane through attachment pins in a third embodiment of the invention.

FIG. 8 shows an embodiment of the invention in which multiple vanes 22 share a single shroud plate 48C having an upstream side 710, a downstream side 72C, and first and second circumferential sides 73C, 74C. A vane 22 with a concave pressure side 27 and a convex suction side 29 is mounted in each of the two upper sockets 80. The lower socket is shown without a vane. Each socket has a vane-receiving opening 79 that matches the cross section profile of the vane airfoil. The vane-receiving opening 79 has a convex curve 81 matching the pressure side 27 of the airfoil, and a concave curve 82 matching the suction side 29 of the airfoil. The circumferential side 73C of the shroud plate is curved to generally follow the adjacent convex curve 81 of a vane-receiving opening 79. The circumferential side 74C of the shroud plate is curved to generally follow the adjacent concave curve 82 of a vane-receiving opening 79. This provides space for circumferential side walls as in FIG. 7. However, instead of circumferential side walls, an alternate structural webbing 88 is shown between each side wall 71C, 72C and each socket wall 80. Such webbing may be formed integrally with the shroud plate by 3D CMC weaving or by CMC fabric lay-up methods as known in the art. Long pins 86 pass through all of the multiple sockets 80. These long pins and their channels may be curved to follow the curvature of the circular shroud ring.

FIG. 9 shows another vane attachment means as described in United States Patent Application Publication 2005/0254942 A1 that avoids the need for pins. Outwardly extending tabs 103 are formed on a CMC shroud plate 48 beside a vane-receiving opening 104 in the plate. A vane airfoil 22 may have a ceramic core 101 and a CMC skin 102. An end 25 of the vane has protruding bosses 105 that fit between the tabs 103. A green-state or partially cured CMC compression ring 106 is placed over the tabs. Differential shrinkage of the compression ring 106 is achieved by firing the vane and platform before assembly, and then firing the CMC rings 106 on the assembly. This produces hoop tension in the ring that clamps the boss 105 between the tabs 103. A filler material 108 may be inserted in gaps between the compression rings 106 and the clamped parts 105 and 103.

FIG. 10 shows a vane attached to a shroud plate 48D formed according to the invention. Outwardly extending tabs 103 are formed on a CMC shroud plate 48D beside a vane-receiving opening 79 in the plate. A vane airfoil may have a ceramic core 101 and a CMC skin 102. An end of the vane has protruding bosses 105 that fit between the tabs 103. A green-state or partially cured CMC compression ring 106 is placed over the tabs 103. Differential shrinkage of the compression ring 106 is produced by firing the vane and platform before assembly, then final-firing the CMC rings on the assembly, resulting in hoop tension in the ring that clamps the bosses 105 between the tabs 103. A filler material 108 may be inserted in gaps between the compression rings 106 and the clamped parts 105 and 103.

Figure 11:
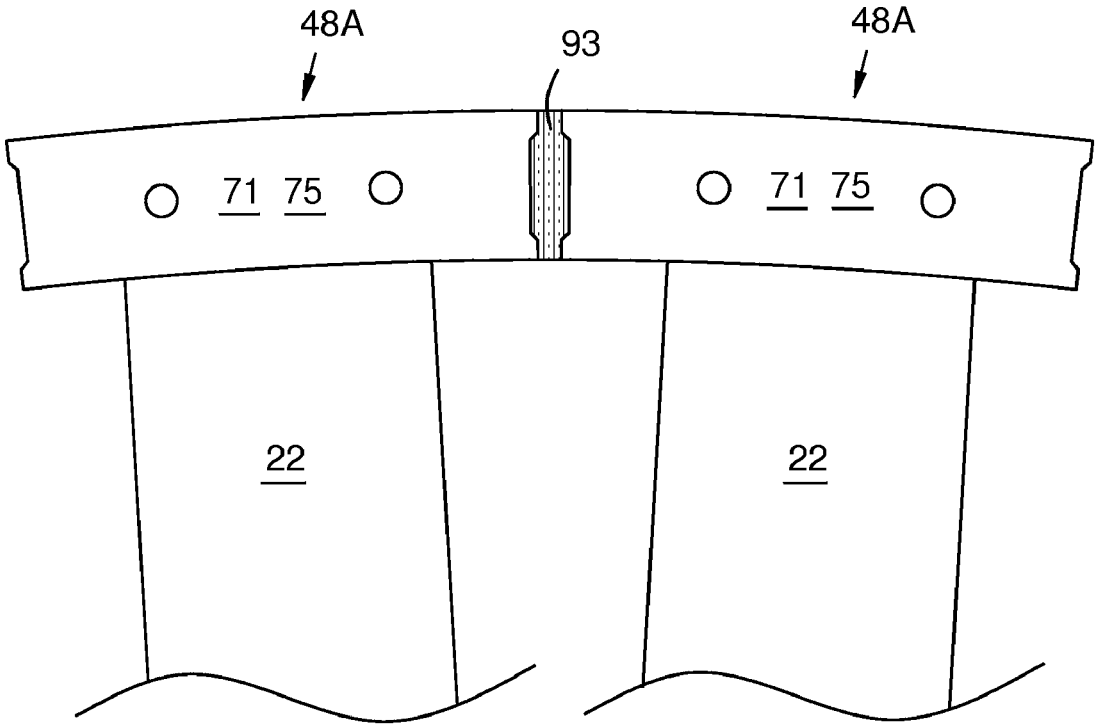
FIG. 11 is a partial axial view of two adjacent vanes and platforms with a compressible ceramic seal between vane shroud plates.

FIG. 11 shows two adjacent vane shroud plates 48A from an upstream viewpoint, with a compressible ceramic seal 93 between them. This seal may be a ceramic felt or a corrugated CMC spring seal as described in co-pending and co-assigned U.S. patent application Ser. No. 12/101,412 filed 11 Apr. 2008, or layers of CMC alternating with spacers to form a CMC leaf spring seal as described in co-pending and co-assigned U.S. patent application Ser. No. 12/366,822 filed 6 Feb. 2009. Compressible ceramic seals are compatible with CMC circumferential frame walls in terms of thermal expansion coefficient. Metal blade seals are not suited for CMC because thin deep slots for the blade seals, while well tolerated in metal parts, cause stress concentrations that are not well tolerated in CMC. There may not be enough depth available for blade seals in the circumferential CMC wall structures of vane shroud plates.

All embodiments described herein provide a CMC frame extending radially outward from the shroud plate, the CMC frame comprising an upstream wall 75A-75D along the upstream side of the shroud plate, a downstream wall 76A-76D along the downstream side of the shroud plate, and a cross-bracing wall structure, either 77A and 78A, 77B and 78B, 77D and 78D, or 80 and 88, that spans between the upstream and downstream walls.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A vane platform element for a gas turbine, comprising:

a CMC shroud plate comprising a radially inner surface, a radially outer surface, an upstream side, a downstream side, and first and second circumferential sides, relative to a central axis of the gas turbine, the sides defining a perimeter of the shroud plate;

a vane-receiving opening in the shroud plate, the vane-receiving opening corresponding to a cross section profile of a turbine vane airfoil, the vane-receiving opening comprising a convex curve adjacent to the first circumferential side of the shroud plate and a concave curve adjacent to the second circumferential side of the shroud plate; and a CMC frame extending radially outward from the shroud plate, the CMC frame comprising an upstream wall along the upstream side of the shroud plate, a downstream wall along the downstream side of the shroud plate, and a cross-bracing wall structure that spans between the upstream and downstream walls;

wherein the first circumferential side of the shroud plate generally follows the convex curve of the vane-receiving opening, and the second circumferential side of the shroud plate generally follows the concave curve of the vane-receiving opening;

wherein the CMC frame extends continuously around the perimeter of the shroud plate, the cross-bracing structure comprising first and second circumferential walls along the respective first and second circumferential sides of the shroud plate;

a socket wall extending radially outward from the shroud plate around the vane-receiving opening; and a pin channel having an access portion passing through at least one of the circumferential walls of the frame, and comprising further portions passing through two sides of the socket wall, all portions of the in channel being substantially mutually aligned.

2. A circular array of adjacent vane platform elements according to claim 1, wherein each pair of adjacent platform elements is separated by a compressible ceramic seal.

3. A vane platform element for a gas turbine, comprising:

a turbine shroud plate comprising a socket that receives an end of a turbine vane airfoil, the socket comprising a vane-receiving opening in the shroud plate, the vane-receiving opening comprising a first side matching a pressure side of the airfoil, and a second side matching a suction side of the airfoil;

the shroud plate comprising a concave circumferential side adjacent to, and generally following the shape of, the first side of the vane-receiving opening, and a convex circumferential side adjacent to, and generally following the shape of, the second side of the vane-receiving opening; and a continuous frame extending radially outward from a perimeter of the shroud plate relative to a central axis of the gas turbine, wherein the frame is formed of side walls around the perimeter of the shroud plate, including first and second circumferential walls following the first and second circumferential sides of the shroud plate;

wherein the socket further comprises an outwardly extending socket wall around the vane-receiving opening, the outwardly extending socket wall comprising a fastening mechanism for attaching the vane airfoil to the turbine shroud plate; and the fastening mechanism comprising a in channel having an access portion passing through one of the circumferential walls of the frame, and comprising further portions passing through two sides of the socket wall, all portions of the in channel being substantially mutually aligned.

4. A vane platform element according to claim 3, comprising:

multiple vane-receiving openings in the shroud plate between the first and second circumferential sides of the shroud plate;

a socket wall extending radially outward from the shroud plate around each vane-receiving opening;

the further portions of the pin channel passing through two sides of each of the socket walls, all portions of the pin channel being substantially mutually aligned following a circular arc of a gas turbine shroud ring.

5. A circular array of adjacent vane platform elements according to claim 3, wherein each pair of adjacent platform elements is separated by a compressible ceramic seal.

6. A vane platform element for a gas turbine, comprising:

a CMC shroud plate comprising a radially inner surface, a radially outer surface, an upstream side, a downstream side, and first and second circumferential sides, relative to a central axis of the gas turbine, the sides defining a perimeter of the shroud plate;

a vane-receiving opening in the shroud plate, the vane-receiving opening corresponding to a cross section profile of a turbine vane airfoil, the vane-receiving opening comprising a convex curve adjacent to the first circumferential side of the shroud plate and a concave curve adjacent to the second circumferential side of the shroud plate; and a CMC frame extending radially outward from the shroud plate, the CMC frame comprising an upstream wall along the upstream side of the shroud plate, a downstream wall along the downstream side of the shroud plate, and a cross-bracing wall structure that spans between the upstream and downstream walls;

wherein the first circumferential side of the shroud plate generally follows the convex curve of the vane-receiving opening, and the second circumferential side of the shroud plate generally follows the concave curve of the vane-receiving opening;

wherein the CMC frame extends continuously around the perimeter of the shroud plate, the cross-bracing structure comprising first and second circumferential walls along the respective first and second circumferential sides of the shroud plate;

multiple vane-receiving openings in the shroud plate between the first and second circumferential sides of the shroud plate;

a socket wall extending radially outward from the shroud plate around each vane-receiving opening; and a pin channel comprising an access portion passing through at least one of the circumferential walls of the frame, and comprising further portions passing through two sides of each of the socket walls, all portions of the pin channel being substantially mutually aligned following a circular arc of a shroud ring of the gas turbine.

* * * * *